US006921300B2

(12) United States Patent
Bartok

(10) Patent No.: US 6,921,300 B2
(45) Date of Patent: Jul. 26, 2005

(54) ELECTRICAL CONNECTOR

(76) Inventor: Joe Bartok, 116 Ryerson Street, Thorold, Ontario (CA), L2V 3Y3

( * ) Notice: Subject to any disclaimer, the term of this patent is extended or adjusted under 35 U.S.C. 154(b) by 0 days.

(21) Appl. No.: 10/796,077

(22) Filed: Mar. 10, 2004

(65) Prior Publication Data

US 2004/0214479 A1 Oct. 28, 2004

Related U.S. Application Data

(60) Provisional application No. 60/457,576, filed on Mar. 27, 2003.

(51) Int. Cl.[7] ..... H01R 4/30; H01R 4/50; H01R 4/38

(52) U.S. Cl. ..... 439/803; 439/807; 439/727

(58) Field of Search ..... 439/727, 803, 439/804, 808, 424, 807, 810, 879; 174/84 C

(56) References Cited

U.S. PATENT DOCUMENTS 2,783,442 A * 2/1957 Burnosky ..... 439/424
4,744,774 A * 5/1988 Pauza ..... 439/225
5,082,461 A * 1/1992 Minnis et al. ..... 439/786
5,259,780 A * 11/1993 Morrissey et al. ..... 439/292
5,316,506 A * 5/1994 Ito ..... 439/879
5,532,433 A * 7/1996 Endo et al. ..... 174/84 C
5,533,914 A * 7/1996 Sawada ..... 439/843
5,733,154 A * 3/1998 Libregts ..... 439/850
2004/0033710 A1 * 2/2004 Kussel et al. ..... 439/271

* cited by examiner

*Primary Examiner*—Chandrika Prasad
(74) *Attorney, Agent, or Firm*—Robert F. Delbridge

(57) ABSTRACT

An electrical connector has an elongated metal base portion, a releasable cable clamp at each opposite end of the base portion, and a connector block of electrical insulating material secured to the base portion between the cable clamps. The connector block has at least one passage therethrough extending from one end of the connector block to an opposite end thereof. A metal connector tube in each passage receives end portions of wires of two electrical cables to effect an electrical connection therebetween, each cable clamp being operable to clamp a respective cable to the connector.

6 Claims, 2 Drawing Sheets

ELECTRICAL CONNECTOR

RELATED APPLICATION

This application claims priority from U.S. Provisional Patent Application No. 60/457576 filed Mar. 27, 2003.

FIELD OF INVENTION

This invention relates to electrical connectors.

BACKGROUND OF INVENTION

Many different types of electrical connectors are of course known. However, there is still a need for an electrical connector which is inexpensive, easy to use and provides a safe and secure electrical connection.

It is therefore an object of the invention to provide such a connector.

SUMMARY OF THE INVENTION

According to the invention, an electrical connector has an elongated metal base portion with a releasable cable clamp at each opposite end, and a connector block of electrical insulating material secured to the base portion between the cable clamps, the connector block having at least one passage there through extending from one end of the connector block to an opposite end thereof, and each passage containing a metal connector tube for receiving end portions of wires of two electrical cables to effect an electrical connection there between, each cable clamp being operable to clamp a respective cable to the connector.

Each clamp may include a retainer member having a projecting tab at one end and engageable in an aperture in the base portion and a screw at the other end which engages in a threaded aperture in a base portion to engage an opposite of the retainer member.

Each connector tube may have inwardly projecting teeth operable to electrically engage and retain a wire therein, and may have a center stop to limit the length of wire which can be inserted therein.

The connector block may be an integral plastic molding, or may have a lower part secured to the base portion and an upper part secured to the lower part.

DESCRIPTION OF THE DRAWINGS

Embodiments of the invention will now be described, by way of example, with reference to the accompanying drawings, of which.

DESCRIPTION OF PREFERRED EMBODIMENTS

Figure 1:
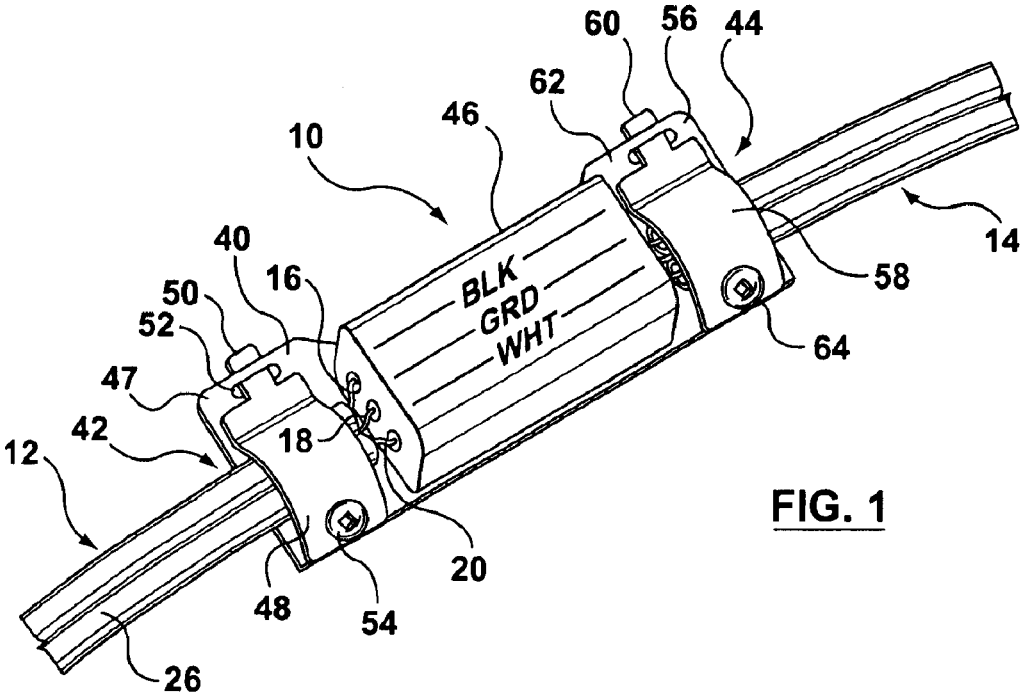
FIG. 1 is a perspective view of an electrical connector in accordance with one embodiment of the invention in which one three-wire cable is connected to another three-wire cable.
Figure 2:
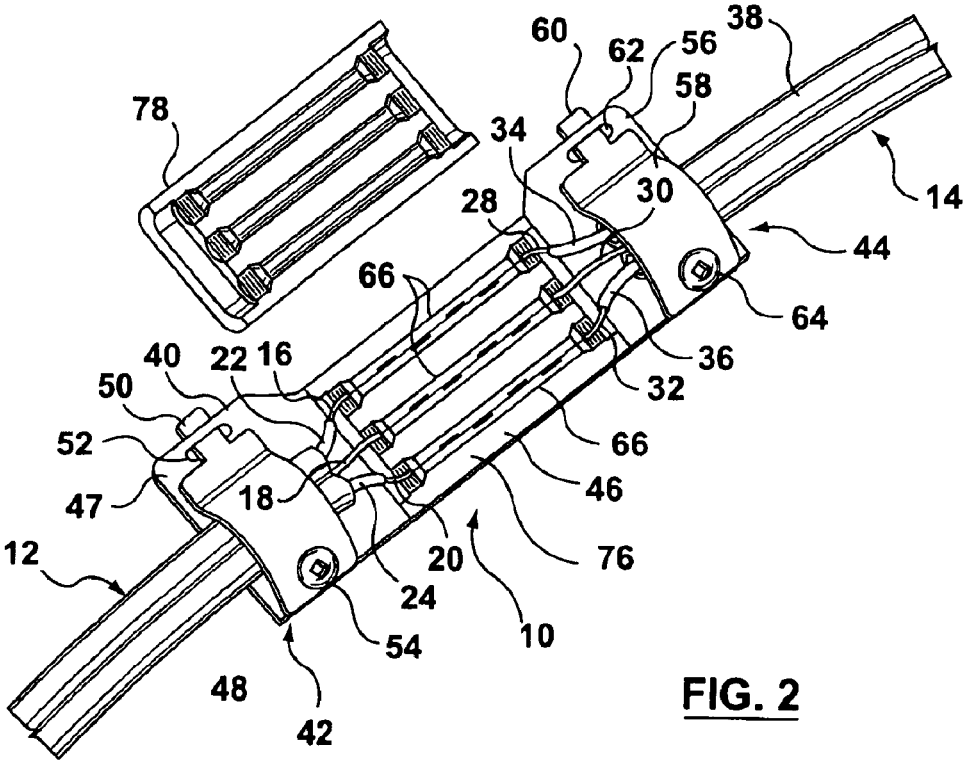
FIG. 2 is a similar view but with the upper part of the connector block removed to show the connector tubes.
Figure 3:
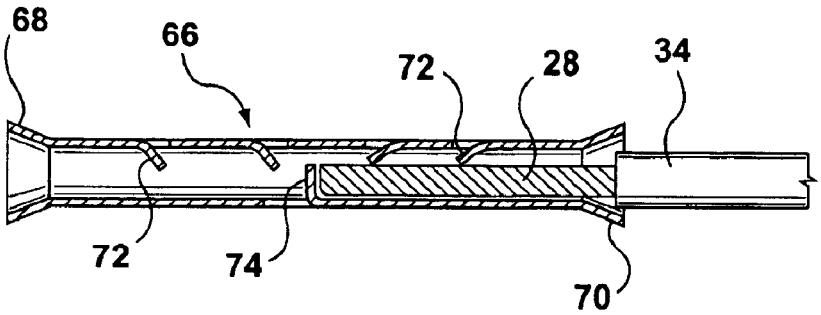
FIG. 3 is a sectional side view of one of the connector tubes.

Referring to the drawings, FIGS. 1–3 show an electrical connector 10 for connecting one three-wire cable 12 to another three-wire cable 14. The first cable 12 has three wires 16, 18, 20, the wires 16, 20 being surrounded by black and white insulating plastic material 22, 24 respectively, and the three wires 16, 18, 20 and insulating material 22, 24 being surrounded by an insulating sheath 26. The wire 18 is a grand wire which is not separately insulated. Similarly, the second cable 14 has three wires 28, 30, 32, the wires 28, 32 being surrounded by black and white insulating material 34, 36 respectively, and the wires 28, 30, 32 and insulating material 34, 36 being surrounded by an insulating sheath 38. The wire 30 is a grand wire which is not separately insulated.

The connector 10 has an elongated metal base portion 40 with a releasable cable clamp 42, 44 at each opposite end. A connector block 46 of electrical insulating material is secured in any suitable manner to the base portion 40 between the clamps 42, 44. The clamp 42 comprises one end part 47 of the base portion 40 and a separate retaining member 48 which extends transversely across the cable 12. Retaining member 48 has a projecting tab 50 at ones side which engages in an aperture 52 in the base end portion 47 and a screw 54 at the other end which passes through an aperture (not shown) in the retaining member 48 and engages in a threaded aperture (not shown) in the base end part 47 at its other end. Likewise, the clamp 44 comprises an opposite end part 56 of the base portion 40 and a retaining member 58 with tab 60 engageable in aperture 62 and a screw 64.

The connector block 46 contains three longitudinally extending metal connector tubes 66, one of which is shown in FIG. 3. The connector tube 66 has flared opposite ends 68, 70 and inwardly projecting integral teeth 72 with a central stop 74. As shown in FIG. 3, the wire 28 has been inserted into one end of the connector tube 66 until it engages the center stop 74. The wire 16 will be inserted into the other end in a similar manner. The teeth 72 engage their respective wires and effect electrical connection there between.

The connector block 46 may be an integral plastic molding as indicated in FIG. 1, or may comprise a lower part 76 secured to the base portion 40 and an upper part 78 secured in a suitable manner to the lower part 76, as shown in FIG. 2.

It will therefore now be understood that the electrical wire 16, 18, 20 of the cable 12 may be readily connected to the wires 28, 30, 32 by the respective connector tubes 66 and that the cables 12, 14 can be readily clamped in place by the clamps 42, 44. To effect clamping, the retaining members 48, 58 are assembled with the base end parts 46, 56 and tightened onto the cables 12, 14 by means of the screws 54, 64. If desired, the central connector tube 66 which connects the ground wires 18, 30 together may be electrically connected in a suitable manner to the metal base portion 40.

Figure 4:
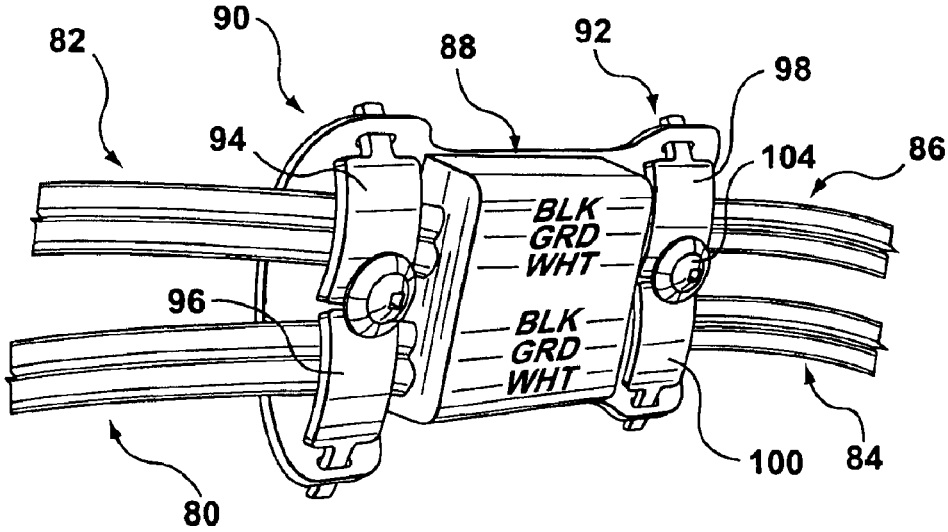
FIG. 4 is similar to FIG. 1 but shows a further embodiment for connecting two three-wire cables to two other three-wire cables.

As shown in FIG. 4, an electrical connector in accordance with another embodiment of the invention enables two three-wire cables 80, 82 to be connected to two other three-wire cables 84, 86 respectively. The connector block 88 contains six connector tubes, and each clamp 90, 92 has two retainer members 94, 96 and 98, 100 respectively. Each pair of retainer members 94, 96 and 98, 100 is tightened by a single screw 102, 104 respectively.

The advantages of the invention will now be readily apparent to a person skilled in the art from the foregoing description of preferred embodiments, and other embodiments of the invention will also now be readily apparent. Further, a person skilled in the art will now appreciate that the invention provides an electrical connector which is inexpensive, easy to use and also effects electrically safe and secure connections. The scope of the invention is defined in the appended claims.

What is claimed is:

1. An electrical connector having an elongated metal base portion, a releasable cable clamp at each opposite end of the base portion, and a connector block of electrical insulating material secured to the base portion between the cable clamps, the connector block having at least one passage there through extending from one end of the connector block to an opposite end thereof, and a metal connector tube in each passage for receiving end portions of wires of two electrical cables to effect an electrical connection there between, each cable clamp being operable to clamp a respective cable to the connector.

2. An electrical connector according to claim 1 wherein each clamp includes a retainer member having a projecting tab at one end engageable in an aperture in the base portion and a screw at the other end which engages in a threaded aperture in the base portion to engage an opposite end of the retainer member.

3. An electrical connector according to claim 1 wherein each metal connector tube has inwardly projecting teeth operable to electrically engage and retain a wire therein.

4. An electrical connector according to claim 3 wherein each connector tube has a center stop to limit the length of wire which can be inserted therein.

5. An electrical connector according to claim 1 wherein the connector block is an integral plastic molding.

6. An electrical connector according to claim 1 wherein the connector block has a lower part secured to the base portion and an upper part secured to the lower part.

* * * * *